US008172549B2

(12) United States Patent
Jensen

(10) Patent No.: US 8,172,549 B2
(45) Date of Patent: May 8, 2012

(54) SELF-VENTILATING CENTRIFUGAL PUMP

(75) Inventor: Jesper Raabjerg Jensen, Middelfart (DK)

(73) Assignee: Alfa Laval Kolding A/S, Kolding (DK)

( * ) Notice: Subject to any disclaimer, the term of this patent is extended or adjusted under 35 U.S.C. 154(b) by 880 days.

(21) Appl. No.: 12/225,330

(22) PCT Filed: Mar. 27, 2007

(86) PCT No.: PCT/EP2007/002669

§ 371 (c)(1),
(2), (4) Date: Sep. 18, 2008

(87) PCT Pub. No.: WO2007/115673

PCT Pub. Date: Oct. 18, 2007

(65) Prior Publication Data

US 2010/0226794 A1 Sep. 9, 2010

(30) Foreign Application Priority Data

Apr. 6, 2006 (DE) ..... 10 2006 016 199

(51) Int. Cl.
*F04B 23/08* (2006.01)
*F04B 23/14* (2006.01)

(52) U.S. Cl. ..... 417/199.2; 417/199.1; 417/201; 415/169.1

(58) Field of Classification Search ..... 417/199.1–206; 415/169.1

See application file for complete search history.

(56) References Cited

U.S. PATENT DOCUMENTS

| | | | | |
|---|---|---|---|---|
| 3,082,694 | A | 3/1963 | Brkich | |
| 3,381,621 | A * | 5/1968 | Luhmann et al. | 415/204 |
| 3,578,880 | A * | 5/1971 | Cygnor | 417/203 |
| 5,116,198 | A * | 5/1992 | Vesala et al. | 415/169.1 |
| 6,409,478 | B1 * | 6/2002 | Carnes et al. | 417/200 |

FOREIGN PATENT DOCUMENTS

| | | |
|---|---|---|
| DE | 548 700 | 4/1932 |
| DE | 614 571 | 6/1935 |
| DE | 21 301 95 | 12/1972 |
| DE | 33 39 679 | 5/1985 |
| DE | 85 28 001 | 2/1986 |
| DE | 35 13 101 | 10/1986 |
| DE | 38 42 249 | 7/1989 |
| DE | 38 42 349 | 6/1990 |

(Continued)

OTHER PUBLICATIONS

German Search Report dated Nov. 15, 2006 along with an English translation of the relevant parts.

(Continued)

*Primary Examiner* — Mariceli Santiago
(74) *Attorney, Agent, or Firm* — Collard & Roe, P.C.

(57) ABSTRACT

In order to ventilate a centrifugal pump (1) having a centrifugal pump outlet space (6) and a centrifugal pump suction space (4), as well as having an additional ventilation pump (3), preferably configured as a vacuum pump, having a ventilation pump inlet (14) and a ventilation pump outlet (15), which pump has a particularly simple structure and which can automatically ventilate itself, if necessary, without any complicate switching processes, it is proposed that both the ventilation pump inlet (14) and the ventilation pump outlet (15) are connected with the centrifugal pump outlet space (6) by way of a connection line (16, 17), in each instance, forming a secondary line.

9 Claims, 2 Drawing Sheets

FOREIGN PATENT DOCUMENTS

Figure 1:
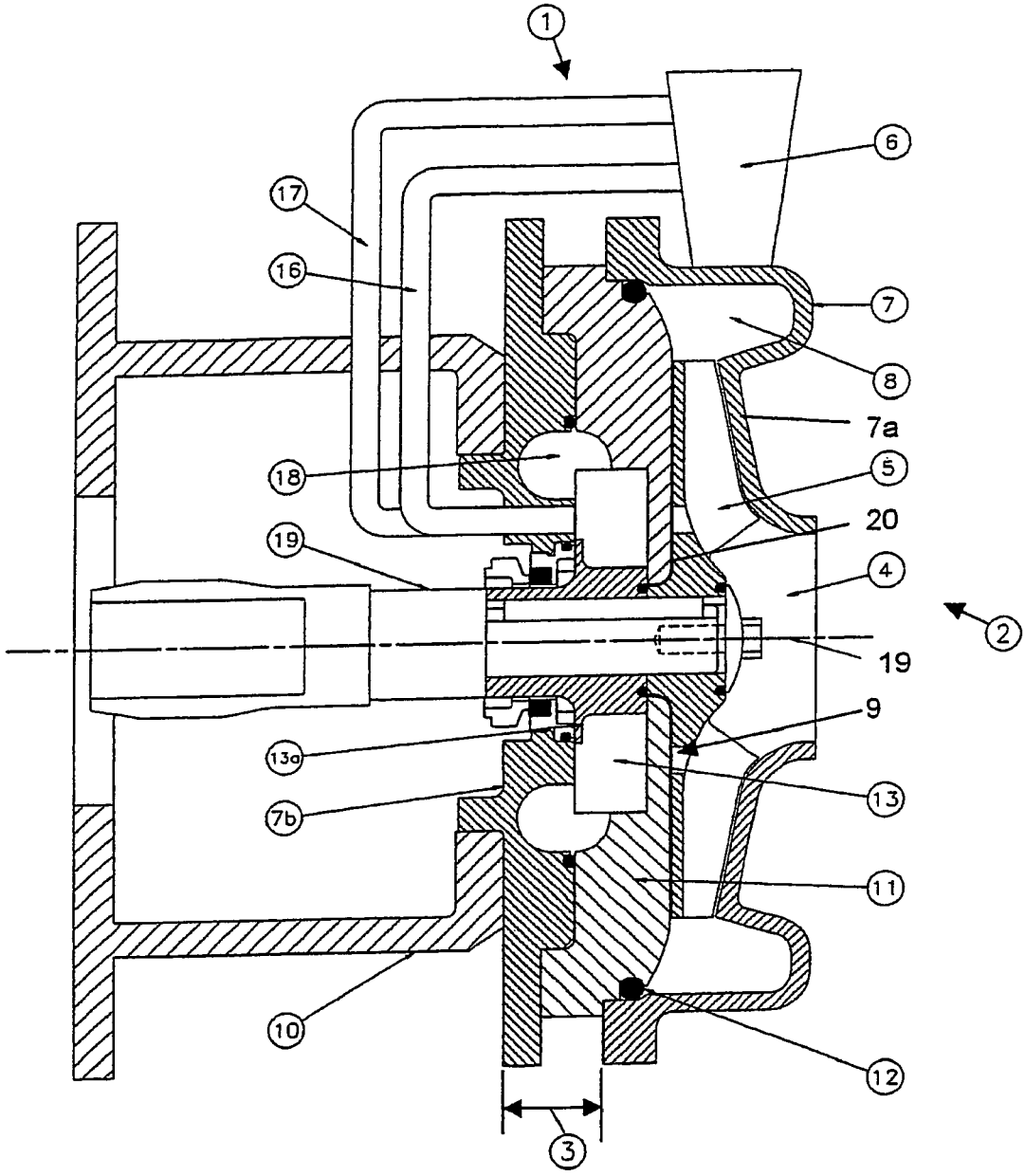

| | | |
|---|---|---|
| DE | 89 00 630 | 7/1990 |
| DE | 40 01 523 | 3/1991 |
| DE | 196 00 776 | 7/1997 |
| GB | 490 907 | 8/1938 |
| JP | 58-008292 | 1/1983 |

OTHER PUBLICATIONS

International Search Report PCT/EP2007/002669 dated Mar. 12, 2008.

* cited by examiner

SELF-VENTILATING CENTRIFUGAL PUMP

CROSS REFERENCE TO RELATED APPLICATIONS

This application is the National Stage of PCT/EP2007/002669 filed on Mar. 27, 2007, which claims priority under 35 U.S.C. §119 of German Application No. 10 2006 016 199.8 filed on Apr. 6, 2006. The international application under PCT article 21(2) was not published in English.

The present invention relates to a centrifugal pump having a centrifugal pump outlet space as well as having an additional ventilation pump, preferably configured as a vacuum pump, having a ventilation pump inlet and a ventilation pump outlet.

Such pumps have been known, in different embodiments, for a long time. In this connection, each of the known pumps is supposed to solve the problem, in this connection, that a rotary pump, i.e. centrifugal pump, is not self-priming in the introductory operating state.

For example, in DE 196 00 776 A1, a centrifugal pump is disclosed, which has a ventilation pump on its rear side. In the case of the previously known centrifugal pump, both the inlet and the outlet of the centrifugal pump are connected with the inlet of the ventilation pump, by way of a valve. For ventilation, the valve of the known centrifugal pump is switched in such a way that the inlet of the centrifugal pump is directly connected with the inlet of the ventilation pump. In normal operation, on the other hand, the valve is switched in such a way that the outlet of the centrifugal pump is connected with the ventilation pump. The ventilation pump is therefore connected both with the inlet and with the outlet of the centrifugal pump.

In this connection, the known principle of the ventilation process is based on the fact that the inlet of the ventilation pump is connected with the inlet of the centrifugal pump to be ventilated. It is a disadvantage in the case of this previously known embodiment of a self-ventilating centrifugal pump that a valve is required, thereby making the structure complex and potentially subject to failure.

A centrifugal pump of the stated type is known from DE8528001U1, in which a ventilation pump is connected with the impeller of the centrifugal pump by way of a line, so that ventilation of the centrifugal pump takes place from the compression space of the centrifugal pump. In this previously known variant, as well, a valve is required in order to carry out ventilation. Again, the requirement of a valve is a disadvantage of this known pump. Furthermore, a completely new design of the centrifugal pump is necessary in order to form the required channel. It is therefore not easily possible to take this ventilation technology over into existing pump designs.

DE 3842349C2, DE 3513101A1, DE 3339679A1 make other embodiments of self-ventilating centrifugal pumps of the stated type known, in which ventilation takes place at the inlet of the centrifugal pump.

Finally, the German Offenlegungsschrift [examined patent application published for public scrutiny] 2130195 relates to a pump assembly having a centrifugal pump and a self-priming pump. In the known pump assembly, an axial-flow pump is connected to the outlet of the centrifugal pump, using a valve, for ventilation. When the valve is switched in this way, the entire volume stream is passed through the axial-flow pump, which functions as a ventilation pump. This can disadvantageously lead to problems, as soon as the centrifugal pump is completely ventilated and begins to transport again, since in this case, the entire volume stream is passed through the centrifugal pump.

The present invention is therefore based on the task of indicating a centrifugal pump of the type stated initially, which has a particularly simple structure and which can ventilate itself automatically if necessary, without any complicated mechanical switching processes.

According to the invention, this task is accomplished with a centrifugal pump according to the preamble of claim 1, in which both the ventilation pump inlet and the ventilation pump outlet are connected with the centrifugal pump outlet space by way of a connection line, in each instance, forming a secondary line.

The advantage of this arrangement according to the invention is that ventilation takes place from the inlet space of the centrifugal pump, in other words from the suction side of the centrifugal pump, by the liquid pump. Because the ventilation line, as a secondary line, is constantly switched in parallel with the outlet space of the centrifugal pump, the need for a valve is eliminated. As a result, the structure becomes particularly simple, on the one hand, and on the other hand it is assured that the ventilation process can start automatically during operation of the centrifugal pump, if necessary, without switching of a valve, for example. It is advantageous that ventilation can take place particularly quickly with the centrifugal pump according to the invention, since the residual medium that generally remains in the pump space is drawn in, in the direction of the pump outlet.

In an embodiment of the invention, the ventilation pump inlet is disposed upstream from the ventilation pump outlet, opening into the centrifugal pump outlet space. The bypass formed by the ventilation pump, together with the connection lines, is formed in such a manner that the secondary stream is also formed in the transport direction of the centrifugal pump. Furthermore, it is practical and therefore advantageous to place the suction line of the ventilation pump as close to the centrifugal pump to be ventilated as possible.

In a particularly advantageous embodiment of the present invention, it is provided that both the ventilation pump inlet and the ventilation pump outlet are disposed in a housing wall, preferably a rear housing wall, of the centrifugal pump. In this way, a particularly compact structure of the centrifugal pump according to the invention is advantageously obtained. In particular, it is advantageously possible to configure the ventilation pump as a cohesive, compact unit.

The centrifugal pump according to the invention is further improved if the centrifugal pump and the ventilation pump are drive-coupled. In this way, it can be advantageously avoided, on the one hand, that an additional drive for the ventilation pump is required, and on the other hand, it is possible to always allow the ventilation pump to run as well—if necessary by way of a translation.

A particularly advantageous embodiment of the centrifugal pump is obtained if the ventilation pump is disposed in the housing of the centrifugal pump.

In a preferred variant of the invention, the ventilation pump is configured as a liquid ring pump. It is known that liquid ring pumps have the property of being self-ventilating. They are therefore particularly well suited for serving as a ventilation pump for a centrifugal pump, which is not self-ventilating per se.

In a further development of the invention, it is provided that the connection lines are oriented horizontally and have a swan's neck shape. This liquid seal ensures that the pump that serves for ventilation, according to the invention, is always completely filled with liquid. It is decisive that the bypass is connected with the outlet of the centrifugal pump.

A particularly advantageous variant of the centrifugal pump according to the invention is obtained if an inlet pipe having a swan's neck shape is placed ahead of the centrifugal pump suction space. In this way, it is advantageously assured, in regular operation of the pump, that the latter is completely filled with medium. In the ventilation principle according to the invention, the ventilation process can advantageously be carried out to such an extent, from the pressure side of the centrifugal pump—in other words from its outlet region—until the medium has been lifted above the swan's neck on the side of the centrifugal pump suction space. The centrifugal pump will then resume normal pump operation.

A possible disadvantageous effect on the pumping performance of the centrifugal pump, brought about because the secondary line is permanently switched on, is avoided, in an advantageous embodiment of the invention, in that a valve is provided in the secondary line, preferably in one of the connection lines (16, 17). The valve can be switched to close the secondary line in normal operation of the centrifugal pump, for example, in order to prevent medium from flowing through the secondary line unnecessarily during normal operation, and thereby from increasing the flow resistance on the pressure side of the centrifugal pump, in undesirable manner.

The task on which the invention is based is also accomplished by means of a method for ventilating a centrifugal pump having a centrifugal pump outlet space and a centrifugal pump suction space, using an additional ventilation pump, preferably configured as a vacuum pump, having a ventilation inlet and a ventilation outlet, in which method, according to the invention, both the ventilation pump inlet and the ventilation pump outlet are connected with the centrifugal pump outlet space by way of a connection line, in each instance, forming a secondary line.

A preferred variant of the method according to the invention provides that the ventilation pump inlet is disposed downstream from the ventilation pump outlet, opening into the centrifugal pump outlet space.

According to another particularly cost-advantageous embodiment of the method according to the invention, the centrifugal pump is drive-coupled with the ventilation pump. In this way, an additional drive for the ventilation pump can be advantageously eliminated.

The invention will be described in a preferred embodiment, making reference to a drawing, as an example, whereby additional advantageous details can be derived from the figures of the drawing.

In this connection, parts that have the same function are provided with the same reference symbol.

Figure 2:
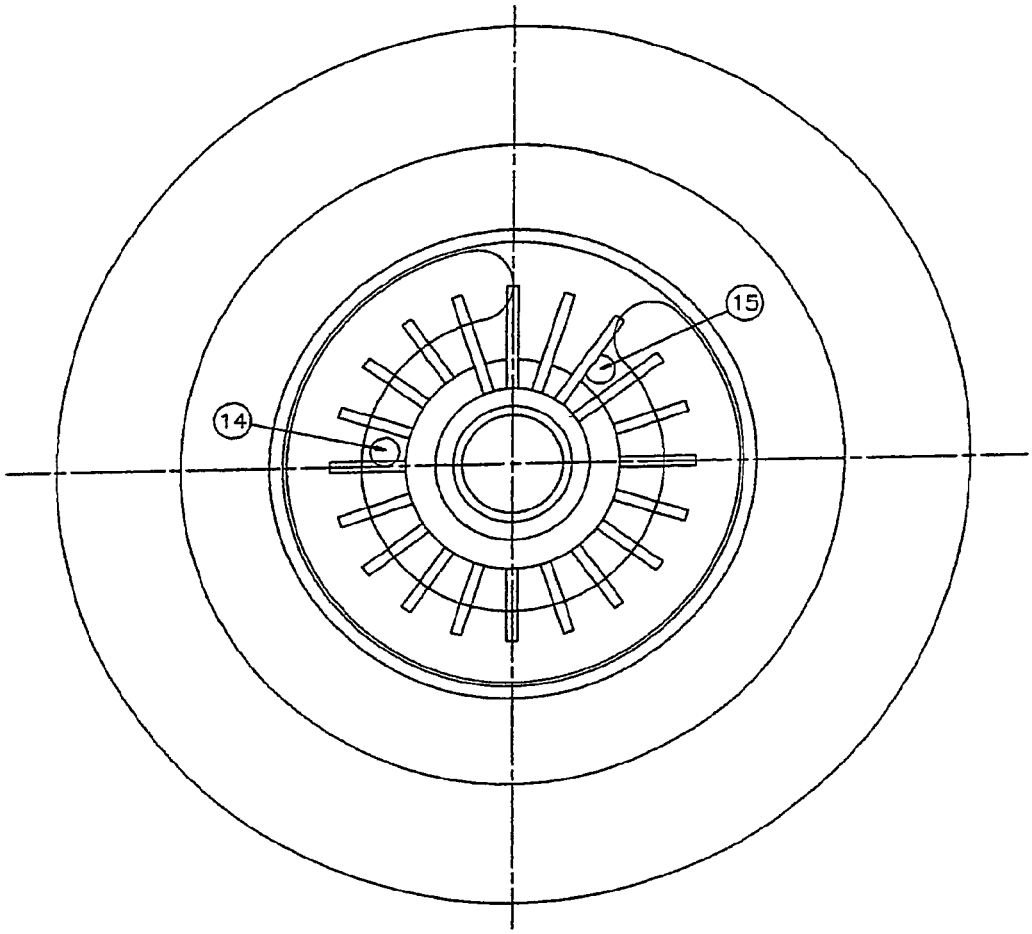

The figures of the drawing show, in detail:

FIG. 1: a schematic axial section of a preferred embodiment of the centrifugal pump according to the invention, and FIG. 2: a schematic radial section of a preferred ventilation pump, according to the invention, for the centrifugal pump according to the invention.

In FIG. 1, a centrifugal pump 1 according to the invention can be seen. The centrifugal pump 1 consists of the centrifugal pump unit 2 as well as the liquid ring pump 3. The centrifugal pump unit 2 has an inlet region 4, an impeller 5, as well as an outlet region 6. The inlet region 4, the impeller 5, and the outlet region 6 are connected with one another by way of a housing 7.

An axis of the pump shaft of the centrifugal pump unit 2 is provided with the reference symbol 19 in FIG. 1.

The ring channel 8 of the centrifugal pump unit 2 is situated between the impeller 5 and the outlet region 6. The centrifugal pump unit 2 has a pump housing 7 consisting of the front part 7*a* as well as a rear wall 7*b*. The front part 7*a* and the rear wall 7*b* are not the same component. The centrifugal pump 1 is directly attached to a drive motor (not shown) with a holder 10 attached to the rear wall 7*b*.

The liquid ring pump 3 is attached, with shape fit, between the front part 7*a* and the rear wall 7*b* of the housing 7 of the centrifugal pump unit 2, with its housing 11. In this connection, the housing 11 of the liquid ring pump 3 seals off the ring channel 8 of the centrifugal pump unit 2 from the front part 7*a* of the housing 7 of the centrifugal pump unit 2, on the inside, forming a seal. A sealing element 12 serves to provide the seal.

The impeller 13 of the liquid ring pump 3 is mounted between rear wall 7*b* and housing 11. The ventilation pump inlet 14 as well as the ventilation pump outlet 15 are situated on the rear side 13*a* of the housing 11 of the liquid ring pump 3 (FIG. 2). The ventilation pump inlet 14 is connected with the outlet region 6 of the centrifugal pump unit 2 by way of a connection line 16. Likewise, the ventilation pump outlet 15 is connected with the outlet region 6 of the centrifugal pump unit 2 by way of a connection line 17.

FIG. 2 shows a schematic sectional representation of the liquid ring pump 3 from FIG. 1. The section is selected in such a manner that the section plane of FIG. 2 stands perpendicular to the section plane of FIG. 1. FIG. 2 particularly shows the arrangement of the impeller 13 of the liquid ring pump 3 relative to the ventilation pump inlet 14 as well as the ventilation pump outlet 15. Partly surrounding the impeller 13 is a liquid ring channel 18. As can be seen in FIG. 2, a volume enclosure occurs between the impeller 13 on the inside edge and the liquid ring channel 18 on the outside edge, which enclosure constantly narrows in the direction of rotation of the impeller 13, from the ventilation pump inlet 14 to the ventilation pump outlet 15. A pressure difference between ventilation pump inlet 14 and ventilation pump outlet 15 occurs as a result of this compression process, in known manner, which pressure difference generates the pumping effect of the liquid ring pump 3.

In the normal operating state of the centrifugal pump 1, the inlet region 4, the ring channel 8, as well as the outlet region 6 are completely filled with medium. There is essentially no air in the centrifugal pump unit 2 in the stated regions.

In this operating state, which generally prevails after a successful startup of the centrifugal pump 1 in normal pumping operation, the medium to be transported is transported out of the inlet region 4 through the ring channel 8 by way of the impeller 5. In this manner, the medium is transported from the inlet region 4 to the outlet region 6, and in the diffuser 6 its pressure is increased.

The liquid ring pump 3, which is also in operation, meanwhile continuously circulates the medium present in the outlet region 6 to the ventilation pump inlet 14, by way of the connection line 16. There, the medium is transported into the intermediate space between the liquid ring channel 18 and the impeller 13, in the direction of the ventilation pump outlet 15, by means of the impeller 13 of the liquid ring pump 3. From the ventilation pump outlet 15, the medium circulates back into the outlet region 6 of the centrifugal pump unit 2, by way of the connection line 17.

In this manner, the connection line 16, with the ventilation pump inlet 14, the impeller 13 of the liquid ring pump 3, as well as the ventilation pump outlet 15, forms a secondary line, i.e. a bypass with the connection line 17, the inlet and outlet of which, respectively, are situated in the outlet region 6 of the centrifugal pump unit 2.

In an operating state in which air is located in any one of the components of the system formed by inlet region 4, region of the impeller 5, ring channel 8, and outlet region 6, the method of functioning of the centrifugal pump 1 is as described below. Such an operating state occurs, for example, if the centrifugal pump 1 is started up from a rest state. On the other hand, the operating state described can also occur in ongoing operation of the centrifugal pump 1, for example.

In this operating state, the centrifugal pump unit 2 is no longer able to increase the pressure in the direction from the inlet region 4 to the outlet region 6. This is attributable to the fact that because of the air present in the suction line of the centrifugal pump unit 2, no medium is flowing through the centrifugal pump unit 2 any longer.

If a residual amount of medium still remains in the ring channel 8 of the centrifugal pump unit 2 or in other regions of the centrifugal pump unit 2 on the low pressure side, this amount is transported further, driven by the impeller 5 of the centrifugal pump unit 2, by way of the ring channel 8, and is finally transported into the outlet region 6 of the centrifugal pump unit 2.

Because of the medium present in the outlet region 6 of the centrifugal pump unit 2, as a result of the effect described, the liquid ring pump 3 is able to circulate medium that comes from the outlet region 6 of the centrifugal pump unit 2 through the ventilation pump inlet 14, by way of the connection line 16, and through the ventilation pump outlet 15, by way of the connection line 17, back into the outlet region 6 of the centrifugal pump unit 2. This continuous circulation of the residual medium present in the outlet region 6 of the centrifugal pump unit 2 generates a suction effect in the region of the liquid pump, as this is actually known for liquid ring pumps. The vacuum generated in the liquid ring pump transports any air present in the inlet region 4 of the centrifugal pump unit 2 out of the region of the impeller 5 and the ring channel 8 of the centrifugal pump unit 2, into the outlet region 6 of the centrifugal pump unit 2, by means of the liquid ring pump 3. In this connection, the air is transferred over to the ring pump through flushing holes 9 in the impeller and the gaps 20 existing between the intermediate wall 11 and the impeller 5, i.e. its shaft. This process continues until the inlet region 4 of the centrifugal pump unit 2 has been completely freed of air.

As soon as no air is present any longer in the system formed by the inlet region 4, the region of the impeller 5, the ring channel 8, and the outlet region 6 of the centrifugal pump unit 2, the centrifugal pump unit 2 of the centrifugal pump 1 starts to transport medium again, in accordance with the normal operating state described above.

The ventilation process according to the invention, as described, is configured in particularly effective manner if a so-called "swan's neck," in other words a curved pipe region that additionally prevents a break in the liquid column in the filled state, not shown in FIG. 1, is disposed in the inlet region 4 of the centrifugal pump unit 2. In this case, the centrifugal pump unit 2 begins to resume normal pumping operation as soon as the medium has been raised above the "swan's neck."

The proposed centrifugal pump 1 has the same advantageous properties of a conventional centrifugal pump, on the one hand. These advantages are combined, in advantageous manner, in the case of the centrifugal pump 1 according to the invention, with the advantageous properties regarding the ability to start up automatically. On the other hand, the known disadvantages of a liquid ring pump, namely that these have a high noise level at low efficiency, are avoided, since the actual pumping performance is produced by the centrifugal pump unit 2. In the case of the centrifugal pump 1 according to the invention, one therefore obtains a combination of the advantageous properties of a centrifugal pump with those of a liquid ring pump.

REFERENCE SYMBOL LIST

| | |
|---|---|
| 1 | centrifugal pump |
| 2 | centrifugal pump unit |
| 3 | liquid ring pump |
| 4 | inlet region |
| 5 | impeller |
| 6 | outlet region, diffuser |
| 7 | housing |
| 7a | front part |
| 7b | rear wall |
| 8 | ring channel |
| 9 | flushing holes |
| 10 | holder |
| 11 | housing (liquid ring pump), intermediate wall |
| 12 | sealing element |
| 13 | impeller (liquid ring pump) |
| 13a | rear side of the impeller 13 |
| 14 | ventilation pump inlet |
| 15 | ventilation pump outlet |
| 16 | connection line |
| 17 | connection line |
| 18 | liquid ring channel |
| 19 | center line of the pump shaft |
| 20 | gap |

The invention claimed is:

1. A centrifugal pump having a centrifugal pump outlet space and a centrifugal pump suction space, as well as having a ventilation pump having a ventilation pump inlet and a ventilation pump outlet, whereby both the ventilation pump inlet and the ventilation pump outlet are connected with the centrifugal pump outlet space by way of a first connection line and a second connection line, wherein the ventilation pump is disposed in a housing of the centrifugal pump, and wherein the ventilation pump is able to circulate medium that comes from the centrifugal pump outlet space, through the ventilation pump inlet by way of the first connection line, and through the ventilation pump outlet by way of the second connection line, back into the centrifugal pump outlet space.

2. The centrifugal pump according to claim 1, wherein the ventilation pump inlet is disposed upstream from the ventilation pump outlet, opening into the centrifugal pump outlet space.

3. The centrifugal pump according to claim 1, wherein both the ventilation pump inlet and the ventilation pump outlet are disposed on a housing wall.

4. The centrifugal pump according to claim 1, wherein the centrifugal pump and the ventilation pump are drive-coupled.

5. The centrifugal pump according to claim 1, wherein the ventilation pump is configured as a liquid ring pump.

6. The centrifugal pump according to claim 1, wherein at least one of the first and second connection lines is oriented horizontally, and has a swan's neck shape.

7. The centrifugal pump according to claim 1, wherein an inlet pipe having a swan's neck shape is placed ahead of the centrifugal pump suction space.

8. The centrifugal pump according to claim 1, wherein a valve is provided in one of the first and second connection lines.

9. A centrifugal pump having a centrifugal pump outlet space and a centrifugal pump suction space, as well as having a ventilation pump having a ventilation pump inlet and a ventilation pump outlet, whereby both the ventilation pump inlet and the ventilation pump outlet are connected with the centrifugal pump outlet space by way of a first connection line and a second connection line, wherein:

the ventilation pump is disposed in a housing of the centrifugal pump, an inlet pipe having a swan's neck shape is placed ahead of the centrifugal pump suction space, and a valve is provided in one of the first and second connection lines.

* * * * *